US006796912B2

(12) United States Patent
Dalton et al.

(10) Patent No.: US 6,796,912 B2
(45) Date of Patent: Sep. 28, 2004

(54) GOLF BALL DIMPLES WITH A CATENARY CURVE PROFILE

(75) Inventors: Jeffrey L. Dalton, Dartmouth, MA (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 171 days.

(21) Appl. No.: 09/989,191

(22) Filed: Nov. 21, 2001

(65) Prior Publication Data

US 2003/0114255 A1 Jun. 19, 2003

(51) Int. Cl.[7] ..... A63B 37/12
(52) U.S. Cl. ..... 473/383
(58) Field of Search ..... 473/378–384

(56) References Cited

U.S. PATENT DOCUMENTS

| | | | | | |
|---|---|---|---|---|---|
| 4,681,323 | A | * | 7/1987 | Alaki et al. | 473/384 |
| 4,729,861 | A | | 3/1988 | Lynch et al. | 264/219 |
| 4,925,193 | A | | 5/1990 | Melvin et al. | 273/232 |
| 5,060,953 | A | * | 10/1991 | Bunger et al. | 473/384 |
| 5,249,804 | A | | 10/1993 | Sanchez | 273/232 |
| 5,562,552 | A | | 10/1996 | Thurman | 473/379 |
| 5,575,477 | A | | 11/1996 | Hwang | 473/379 |
| 5,688,194 | A | * | 11/1997 | Stiefel et al. | 473/383 |
| 5,713,801 | A | | 2/1998 | Aoyama | 473/354 |
| 5,803,831 | A | | 9/1998 | Sullivan et al. | 473/374 |
| 5,885,172 | A | | 3/1999 | Hebert et al. | 473/354 |
| 5,919,100 | A | | 7/1999 | Boehm et al. | 473/354 |
| 5,957,787 | A | | 9/1999 | Hwang | 473/379 |
| 5,965,669 | A | | 10/1999 | Cavallaro et al. | 525/221 |
| 5,981,654 | A | | 11/1999 | Rajagopalan | 525/66 |
| 5,981,658 | A | | 11/1999 | Rajagopalan et al. | 525/72 |
| 6,149,535 | A | | 11/2000 | Bissonnette et al. | 473/354 |
| 6,186,002 | B1 | | 2/2001 | Lieberman et al. | 73/432.1 |
| 6,331,150 | B1 | | 12/2001 | Ogg | 473/383 |
| 2001/0009310 | A1 | | 7/2001 | Hebert et al. | 264/129 |
| 2002/0123390 | A1 | | 9/2002 | Byrne et al. | 473/280 |
| 2002/0123395 | A1 | | 9/2002 | Murphy et al. | 473/378 |

* cited by examiner

*Primary Examiner*—Raeann Gorden
(74) *Attorney, Agent, or Firm*—Swidler Berlin Shereff Friedman, LLP

(57) ABSTRACT

A golf ball having an outside surface with a plurality of dimples formed thereon. The dimples on the ball have a cross-sectional profiles formed by a catenary curve. Shape constants in the catenary curve are used to vary the ball flight performance according to ball spin characteristics and player swing speed.

5 Claims, 4 Drawing Sheets

TABLE 1. Dimple Characteristics

| Shape Factor, a | Dimple Radius, r | Dimple Depth, d | Volume Ratio, vr |
|---|---|---|---|
| 20 | 0.05 | 0.025 | 0.51 |
| 40 | 0.05 | 0.025 | 0.55 |
| 60 | 0.05 | 0.025 | 0.60 |
| 80 | 0.05 | 0.025 | 0.64 |
| 100 | 0.05 | 0.025 | 0.69 |

GOLF BALL DIMPLES WITH A CATENARY CURVE PROFILE

FIELD OF INVENTION

The present invention relates to a golf ball, and more particularly, to the cross-sectional profile of dimples on the surface of a golf ball.

BACKGROUND OF THE INVENTION

Golf balls were originally made with smooth outer surfaces. In the late nineteenth century, players observed that the guttie golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's , almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which, not surprisingly, had 384 dimples that were arranged in an icosahedral pattern. About 76 percent of its outer surface was covered with dimples. Today's dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators.

In addition to researching dimple pattern and size, golf ball manufacturers also study the effect of dimple shape, volume, and cross-section on overall flight performance of the ball. One example is U.S. Pat. No. 5,737,757, which discusses making dimples using two different spherical radii with an inflection point where the two curves meet. In most cases, however, the cross-sectional profiles of dimples in prior art golf balls are parabolic curves, ellipses, semi-spherical curves, saucer-shaped, a sine curve, a truncated cone, or a flattened trapezoid. One disadvantage of these shapes is that they can sharply intrude into the surface of the ball, which may cause the drag to become greater than the lift. As a result, the ball may not make best use of momentum initially imparted thereto, resulting in an insufficient carry of the ball. Despite all the cross-sectional profiles disclosed in the prior art, there has been no disclosure of a golf ball having dimples defined by the revolution of a catenary curve.

SUMMARY OF THE INVENTION

The present invention is directed to defining dimples on a golf ball by revolving a catenary curve about its symmetrical axis. In one embodiment, the catenary curve is defined by a hyperbolic sine function. In another embodiment, the catenary curve is defined by a hyperbolic cosine function. In a preferred embodiment, the catenary curve used to define a golf ball dimple is a hyperbolic cosine function in the form of:

$$Y = \frac{d(\cosh(ax) - 1)}{\cosh(ar) - 1}$$

where:

Y is the vertical distance from the dimple apex, x is the radial distance from the dimple apex, a is the shape constant;

d is the depth of the dimple, and r is the radius of the dimple.

BRIEF DESCRIPTION OF THE DRAWINGS

These and other aspects of the present invention may be more fully understood with reference to, but not limited by, the following drawings.

DETAILED DESCRIPTION OF THE INVENTION

The present invention is a golf ball which comprises dimples defined by the revolution of a catenary curve about an axis. A catenary curve represents the curve formed by a perfectly flexible, uniformly dense, and inextensible cable suspended from its endpoints. In general, the mathematical formula representing such a curve is expressed as the equation:

$$y=a\cosh(bx)$$

where a and b are constants, y is the vertical axis and x is the horizontal axis on a two dimensional graph. The dimple shape on the golf ball is generated by revolving the caternary curve about its y axis.

The present invention uses variations of this mathematical expression to define the cross-section of golf ball dimples. In the present invention, the catenary curve is defined by hyperbolic sine or cosine functions. A hyperbolic sine function is expressed as follows:

$$\sinh(x) = \frac{e^x - e^{-x}}{2}$$

while a hyperbolic cosine function is expressed by the following formula:

$$\cosh(x) = \frac{e^x + e^{-x}}{2}.$$

In one embodiment of the present invention, the mathematical equation for describing the cross-sectional profile of a dimple is expressed by the following formula:

$$Y = \frac{d(\cosh(ax) - 1)}{\cosh(ar) - 1}$$

where:

Y is the vertical distance from the dimple apex;

x is the radial distance from the dimple apex to the dimple surface;

a is a shape constant (also called shape factor);

d is the depth of the dimple; and r is the radius of the dimple.

The "shape constant" or "shape factor", a, is an independent variable in the mathematical expression for a catenary curve. The shape factor may be used to independently alter the volume ratio of the dimple while holding the dimple depth and radius fixed. The volume ratio is the fractional ratio of the dimple volume divided by the volume of a cylinder defined by a similar radius and depth as the dimple.

Use of the shape factor provides an expedient method of generating alternative dimple profiles, for dimples with fixed radii and depth. For example, if a golf ball designer desires to generate balls with alternative lift and drag characteristics for a particular dimple position, radius, and depth on a golf ball surface, then the golf ball designer may simply describe alternative shape factors to obtain alternative lift and drag performance without having to change these other parameters. No modification to the dimple layout on the surface of the ball is required.

Figure 1:
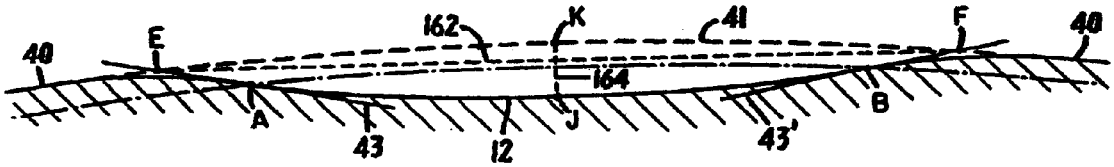
FIG. 1 shows a method for measuring the depth and radius of a dimple.
Figure 2:
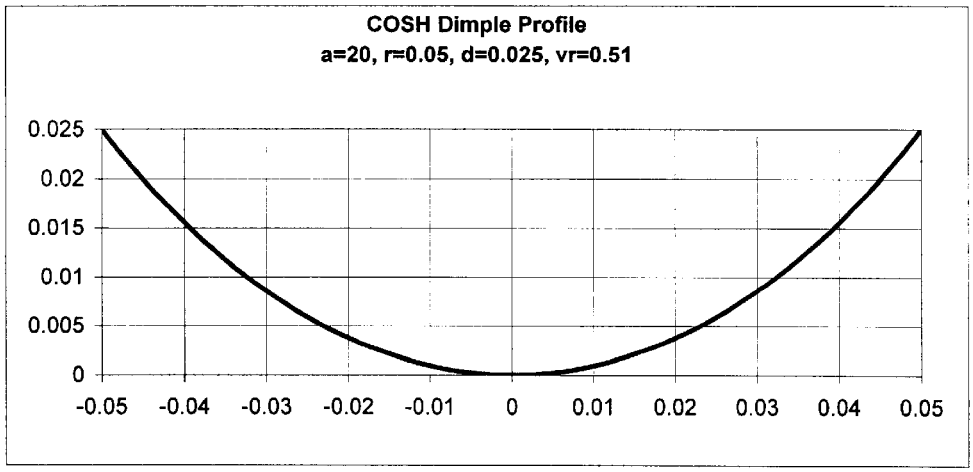
FIG. 2 is a dimple cross-sectional profile defined by a hyperbolic cosine function, cosh, with a shape constant of 20, a dimple depth of 0.025 inches, a dimple radius of 0.05 inches, and a volume ratio of 0.51.
Figure 3:
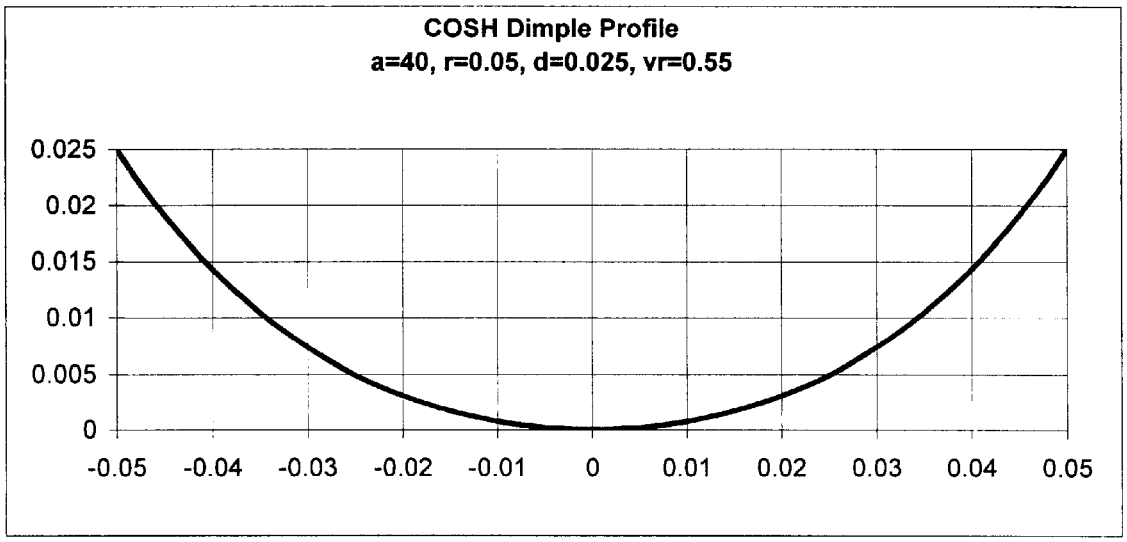
FIG. 3 is a dimple cross-sectional profile defined by a hyperbolic cosine function, cosh, with a shape constant of 40, a dimple depth of 0.025 inches, a dimple radius of 0.05 inches, and a volume ratio of 0.55.
Figure 4:
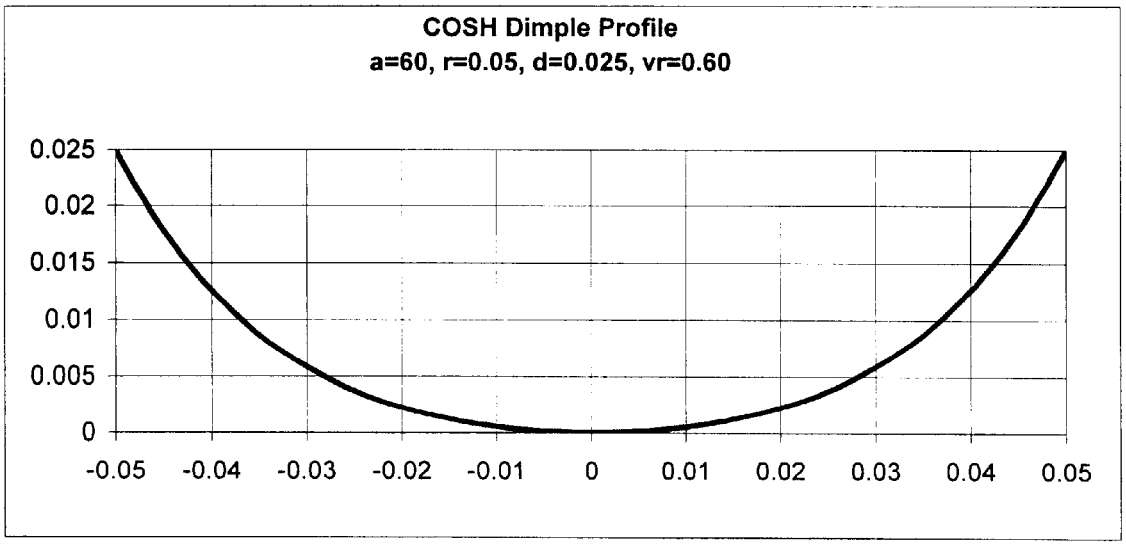
FIG. 4 is a dimple cross-sectional profile defined by a hyperbolic cosine function, cosh, with a shape constant of 60, a dimple depth of 0.025 inches, a dimple radius of 0.05 inches, and a volume ratio of 0.60.
Figure 5:
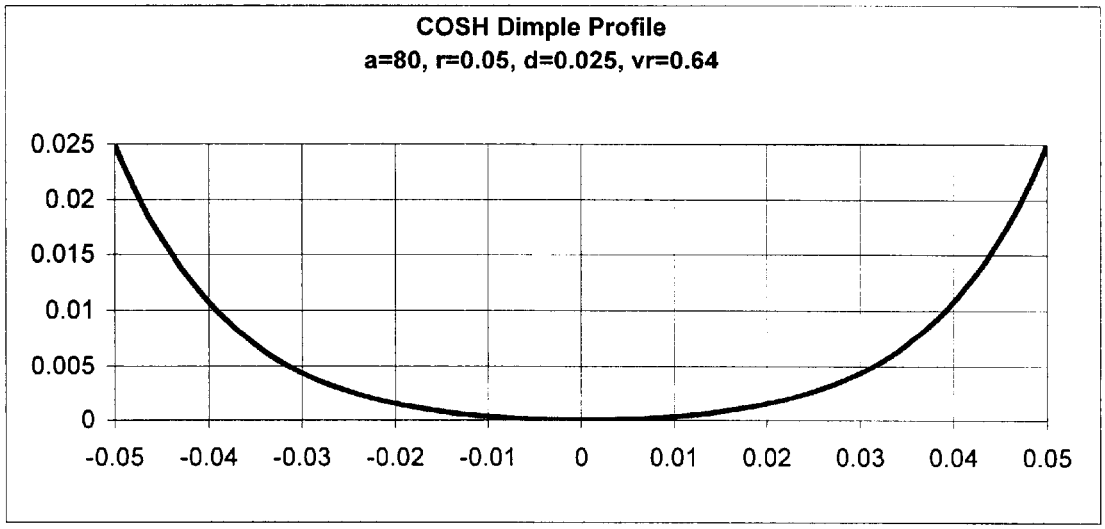
FIG. 5 is a dimple cross-sectional profile defined by a hyperbolic cosine function, cosh, with a shape constant of 80, a dimple depth of 0.025 inches, a dimple radius of 0.05 inches, and a volume ratio of 0.64.
Figure 6:
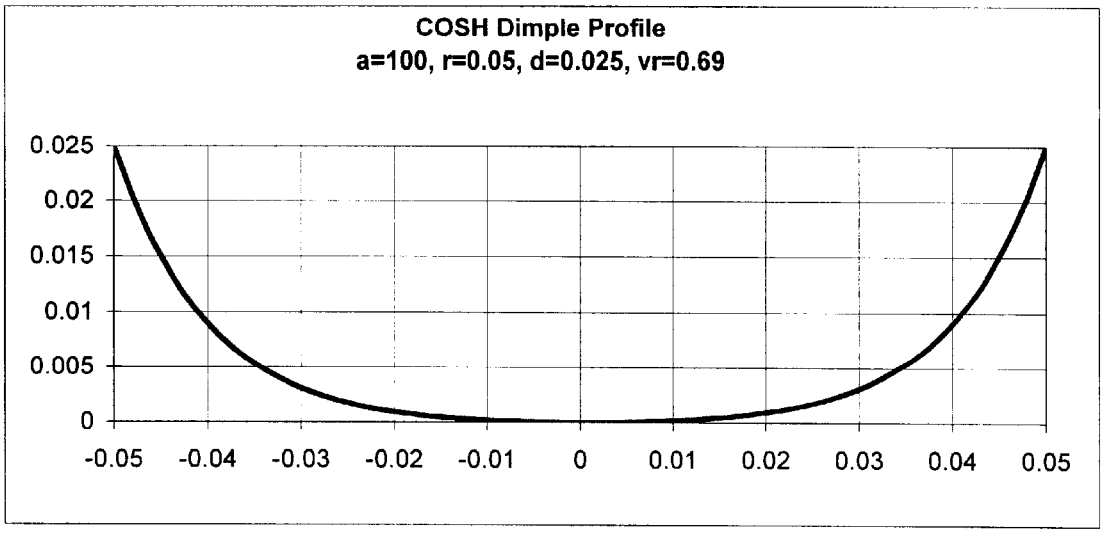
FIG. 6 is a dimple cross-sectional profile defined by a hyperbolic cosine function, cosh, with a shape constant of 100, a dimple depth of 0.025 inches, a dimple radius of 0.05 inches, and a volume ratio of 0.69.

The depth (d) and radius (r) (r=½ diameter (D)) of the dimple may be measured as described in U.S. Pat. No. 4,729,861 (shown in FIG. 1), the disclosure of which is incorporated by reference in its entirety.

For the equation provided above, shape constant values that are larger than 1 result in dimple volume ratios greater than 0.5. Preferably, shape factors are between about 20 to about 100. FIGS. 2–6 illustrate dimple profiles for shape factors of 20, 40, 60, 80, and 100, respectively. Table 1 illustrates how the volume ratio changes for a dimple with a radius of 0.05 inches and a depth of 0.025 inches.

TABLE 1

| Shape Factor | Volume Ratio |
|---|---|
| 20 | 0.51 |
| 40 | 0.55 |
| 60 | 0.60 |
| 80 | 0.64 |
| 100 | 0.69 |

As shown above, increases in shape factor result in higher volume ratios for a given dimple radius and depth.

A dimple whose profile is defined by the cosh catenary curve with a shape constant of less than about 40 will have a smaller dimple volume than a dimple with a spherical profile. This will result in a higher trajectory and longer carry distance. On the other hand, a dimple whose profile is defined by the cosh catenary curve with a shape constant of greater than about 40 will have a larger dimple volume than a dimple with a spherical profile. This will result in a lower trajectory and longer total distance.

Therefore, a golf ball having dimples defined by a catenary curve with a shape constant is advantageous because the shape constant may be selected to optimize the flight profile of specific ball designs. For example, one would preferably select a shape factor greater than about 40, more preferably greater than about 50, for balls which exhibit high spin rate characteristics. Conversely, one would select a low shape factor for balls which exhibit low spin rate characteristics. For instance a designer may select a shape factor lower than about 50, or more preferably less than about 40, for low spin balls. Thus, golf balls with dimples described by the revolution of a catenary curve allow for improved ball performance and more efficient variability of design. Furthermore, the shape factor of catenary curves provides golf ball designers with a simple single factor for trajectory optimization.

In addition to designing a dimple shape according to the ball spin characteristics, the use of a catenary curve profile allows designers to more easily consider the player swing speed in optimizing ball performance. The flight distance and roll of a golf ball are strongly influenced by the ball speed, launch angle and spin rate obtained as a result of collision with the club. The lift and drag generated during the ball's flight are influenced by atmospheric conditions, ball size, and dimple geometry. To obtain maximum distance the dimple geometry may be selected such that an optimal combination of lift and drag is obtained. The dimple shape factor may thus be used to provide balls that yield optimal flight performance for specific swing speed categories. The advantageous feature of shape factor is that dimple location need not be manipulated for each swing speed; only the dimple shape will be altered. Thus, a "family" of golf balls may have a similar general appearance although the dimple shape is altered to optimize flight characteristics for particular swing speeds. Table 2 identifies examples of preferred ball designs for players of differing swing speeds.

TABLE 2

| Ball Design | Dimple Shape Factor | Ball Speed from driver (mph) | Cover Hardness (Shore D) | Ball Compression (Atti) |
|---|---|---|---|---|
| 1 | 80 | 155–175 | 45–55 | 60–75 |
| 2 | 90 | 155–175 | 45–55 | 75–90 |
| 3 | 100 | 155–175 | 45–55 | 90–105 |
| 4 | 70 | 155–175 | 55–65 | 60–75 |
| 5 | 80 | 155–175 | 55–65 | 75–90 |
| 6 | 90 | 155–175 | 55–65 | 90–105 |
| 7 | 55 | 155–175 | 65–75 | 60–75 |
| 8 | 65 | 155–175 | 65–75 | 75–90 |
| 9 | 75 | 155–175 | 65–75 | 90–105 |
| 10 | 65 | 140–155 | 45–55 | 60–75 |
| 11 | 75 | 140–155 | 45–55 | 75–90 |
| 12 | 85 | 140–155 | 45–55 | 90–105 |
| 13 | 55 | 140–155 | 55–65 | 60–75 |
| 14 | 65 | 140–155 | 55–65 | 75–90 |
| 15 | 75 | 140–155 | 55–65 | 90–105 |
| 16 | 40 | 140–155 | 65–75 | 60–75 |
| 17 | 50 | 140–155 | 65–75 | 75–90 |
| 18 | 60 | 140–155 | 65–75 | 90–105 |
| 19 | 50 | 125–140 | 45–55 | 60–75 |
| 20 | 60 | 125–140 | 45–55 | 75–90 |
| 21 | 70 | 125–140 | 45–55 | 90–105 |
| 22 | 40 | 125–140 | 55–65 | 60–75 |
| 23 | 50 | 125–140 | 55–65 | 75–90 |
| 24 | 60 | 125–140 | 55–65 | 90–105 |
| 25 | 25 | 125–140 | 65–75 | 60–75 |
| 26 | 35 | 125–140 | 65–75 | 75–90 |
| 27 | 45 | 125–140 | 65–75 | 90–105 |

Table 2 shows that as the spin rate and ball speed increase the shape factor should also increase to provide optimal aerodynamic performance, increased flight distance. While the shape factors listed above illustrate preferred embodiments for varying ball constructions and ball speeds, the shape factors listed above for each example may be varied without departing from the spirit and scope of the present invention. For instance, in one embodiment the shape factors listed for each example above may be adjusted upwards or downwards by 20 to arrive at a further customized ball design. More preferably, the shape factors may be adjusted upwards or downwards by 10, and even more preferably it may be adjusted by 5.

To illustrate the selection of shape factors in dimple design from Table 2, the preferred dimple shape factor for a ball having a cover hardness of about 45 to about 55 Shore D and a ball compression of about 60 to about 75 Atti for a player with a ball speed from the driver between about 140 and about 155 mph would be about 65. Likewise, the preferred shape factor for the same ball construction, but for a player having a ball speed from the driver of between about 155 mph and about 175 mph would be about 80. As mentioned above, these preferred shape factors may be adjusted upwards or downwards by 20, 10, or 5 to arrive at a further customized ball design.

Thus, shape factors may be selected for a particular ball construction that result in a ball designed to work well with a wide variety of player swing speeds. For instance, in one embodiment of the present invention, a shape factor between about 65 and about 100 would be suitable for a ball with a cover hardness between about 45 and about 55 shore D.

The present invention may be used with practically any type of ball construction. For instance, the ball may have a 2-piece design, a double cover or veneer cover construction depending on the type of performance desired of the ball. Examples of these and other types of ball constructions that may be used with the present invention include those described in U.S. Pat. Nos. 5,713,801, 5,803,831, 5,885,172, 5,919,100, 5,965,669, 5,981,654, 5,981,658, and 6,149,535, as well as in Publication No. US2001/0009310 A1. Different materials also may be used in the construction of the golf balls made with the present invention. For example, the cover of the ball may be made of polyurethane, ionomer resin, balata or any other suitable cover material known to those skilled in the art. Different materials also may be used for forming core and intermediate layers of the ball. After selecting the desired ball construction, the flight performance of the golf ball can be adjusted according to the design, placement, and number of dimples on the ball. As explained above, the use of catanary curves provides a relatively effective way to modify the ball flight performance without significantly altering the dimple pattern. Thus, the use of catenary curves defined by shape factors allows a golf ball designer to select flight characteristics of a golf ball in a similar way that different materials and ball constructions can be selected to achieve a desired performance.

While the present invention is directed toward using a catenary curve for at least one dimple on a golf ball, it is not necessary that catenary curves be used on every dimple on a golf ball. In some cases, the use of a catenary curve may only be used for a small number of dimples. It is preferred, however, that a sufficient number of dimples on the ball have catenary curves so that variation of shape factors will allow a designer to alter the ball's flight characteristics. Thus, it is preferred that a golf ball have at least about 30%, and more preferably at least about 60%, of its dimples defined by a catenary curves.

Moreover, it is not necessary that every dimple have the same shape factor. Instead, differing combinations of shape factors for different dimples on the ball may be used to achieve desired ball flight performance. For example, some of the dimples defined by catenary curves on a golf ball may have one shape factor while others have a different shape factor. In addition, the use of differing shape factors may be used for different diameter dimples. While two or more shape factors may be used for dimples on a golf ball, it is preferred that the differences between the shape factors be relatively similar in order to achieve optimum ball flight performance that corresponds to a particular ball construction and player swing speed. Preferably, a plurality of shape factors used to define dimples having catenary curves do not differ by more than 30, and even more preferably have shape factors that do not differ by more than 15.

Desirable dimple characteristics are more precisely defined by aerodynamic lift and drag coefficients, $C_l$ and $C_d$ respectively. These aerodynamic coefficients are used to quantify the force imparted to a ball in flight. The lift and drag forces are computed as follows:

$$F_{lift}=0.5\rho C_l A V^2$$

$$F_{drag}=0.5\rho C_d A V^2$$

where:

$\rho$=air density $C_l$=lift coefficient $C_d$=drag coefficient

A=ball area=$\pi r_2$ (where r=ball radius), and

V=ball velocity

Lift and drag coefficients are dependent on air density, air viscosity, ball speed, and spin rate. A common dimensionless quantity for tabulating lift and drag coefficients is Reynolds number. Reynolds number quantifies the ratio of inertial to viscous forces acting on an object moving in a fluid. Reynolds number is calculated as follows:

$$R = \frac{VD\rho}{\mu}$$

where:

R=Reynolds number

V=velocity

D=ball diameter

ρ=air density, and $\mu$=air viscosity

In the examples that follow, standard atmospheric values of 0.00238 slug/ft$^3$ for air density and $3.74\times10^7$ lb*sec/ft$^2$ for air viscosity are used to calculate Reynolds number. For example, at standard atmospheric conditions a golf ball with a velocity of 160 mph would have a Reynolds number of 209,000. typically, the lift and drag coefficients of a golf ball are measured at a variety of spin rates and Reynolds numbers. For example, U.S. Pat. No. 6,186,002 teaches the use of a series of ballistic screens to acquire lift and drag coefficients at numerous spin rates and Reynolds numbers. Other techniques utilized to measure lift and drag coefficients include conventional wind tunnel tests. One skilled in the art of aerodynamics testing could readily determine the lift and drag coefficients with either wind tunnel or ballistic screen technology. An additional parameter often used to characterize the air flow over rotating bodies is the spin ratio. Spin ratio is the rotational surface speed of the body divided by the free stream velocity. The spin ratio is calculated as follows:

$$SpinRatio = \frac{2(\text{rps})\pi r}{V}$$

where:

rps=revolutions per second of the ball r=ball radius, and

V=ball velocity

For a golf ball of any diameter and weight, increased distance is obtained when the lift force, $F_{lift}$, on the ball is greater than the weight of the ball but preferably less than three times its weight. This may be expressed as:

$$W_{ball} \leq F_{lift} \leq 3W_{ball}$$

The preferred lift coefficient range which ensures maximum flight distance is thus:

$$\frac{2W_{ball}}{\pi r^2 V^2} \leq C_l \leq \frac{6W_{ball}}{\pi r^2 V^2}$$

The lift coefficients required to increase flight distance for golfers with different ball launch speeds may be computed using the formula provided above. Table 3 provides several examples of the preferred range for lift coefficients for alternative launch speeds, ball size, and weight:

TABLE 3

PREFERRED RANGES FOR LIFT COEFFICIENT FOR A GIVEN BALL DIAMETER, WEIGHT, AND LAUNCH VELOCITY FOR A GOLF BALL ROTATING AT 3000 RPM

| Preferred Minimum $C_1$ | Preferred Maximum $C_1$ | Ball Diameter (in.) | Ball Weight (oz.) | Ball Velocity (ft/s) | Reynolds Number | Spin Ratio |
|---|---|---|---|---|---|---|
| 0.09 | 0.27 | 1.75 | 1.8 | 250 | 232008 | 0.092 |
| 0.08 | 0.24 | 1.75 | 1.62 | 250 | 232008 | 0.092 |
| 0.07 | 0.21 | 1.75 | 1.4 | 250 | 232008 | 0.092 |
| 0.10 | 0.29 | 1.68 | 1.8 | 250 | 222727 | 0.088 |
| 0.09 | 0.27 | 1.68 | 1.62 | 250 | 222727 | 0.088 |
| 0.08 | 0.23 | 1.68 | 1.4 | 250 | 222727 | 0.088 |
| 0.12 | 0.37 | 1.5 | 1.8 | 250 | 198864 | 0.079 |
| 0.11 | 0.33 | 1.5 | 1.62 | 250 | 198864 | 0.079 |
| 0.10 | 0.29 | 1.5 | 1.4 | 250 | 198864 | 0.079 |
| 0.14 | 0.42 | 1.75 | 1.8 | 200 | 185606 | 0.115 |
| 0.13 | 0.38 | 1.75 | 1.62 | 200 | 185606 | 0.115 |
| 0.11 | 0.33 | 1.75 | 1.4 | 200 | 185606 | 0.115 |
| 0.15 | 0.46 | 1.68 | 1.8 | 200 | 178182 | 0.110 |
| 0.14 | 0.41 | 1.68 | 1.62 | 200 | 178182 | 0.110 |
| 0.12 | 0.36 | 1.68 | 1.4 | 200 | 178182 | 0.110 |
| 0.19 | 0.58 | 1.5 | 1.8 | 200 | 159091 | 0.098 |
| 0.17 | 0.52 | 1.5 | 1.62 | 200 | 159091 | 0.098 |
| 0.15 | 0.45 | 1.5 | 1.4 | 200 | 159091 | 0.098 |

Once a dimple pattern is selected for the golf ball a shape factor for a catenary dimple profile may be used to achieve the desired lift coefficient. Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment of the present invention, the dimple pattern is at least partially defined by phyllotaxis-based patterns, such as those described in copending U.S. patent application Ser. No. 09/418,003, which is incorporated by reference in its entirety. Preferably a dimple pattern that provides greater than about 50% surface coverage is selected. Even more preferably, the dimple pattern provides greater than about 70% surface coverage. Once the dimple pattern is selected, several alternative shape factors for the catenary profile can be tested in a wind tunnel or light gate test range to empirically determine the catenary shape factor that provides the desired lift coefficient at the desired launch velocity. Preferably, the measurement of lift coefficient is performed with the golf ball rotating at typical driver rotation speeds. A preferred spin rate for performing the lift and drag tests is 3,000 rpm.

The catenary shape factor may thus be used to provide a family of golf balls which have the same dimple pattern but alternative catenary shape factors. The catenary shape factors allow the ball designer to tailor each ball in the family for maximum distance for a given launch speed. Furthermore, the golf balls may be of a variety of alternative sizes and weights.

As discussed above, catenary curves may be used to define dimples on any type of golf ball, including golf balls having solid, wound, liquid filled or dual cores, or golf balls having multilayer intermediate layer or cover layer constructions. While different ball construction may be selected for different types of playing conditions, the use of catenary curves would allow greater flexibility to ball designers to better customize a golf ball to suit a player.

While the invention has been described in conjunction with specific embodiments, it is evident that numerous alternatives, modifications, and variations will be apparent to those skilled in the art in light of the foregoing description.

What is claimed is:

1. A golf ball having a plurality of recessed dimples on the surface thereof, wherein at least one dimple is defined by the revolution of a Catenary curve, wherein the Catenary curve is defined by hyperbolic cosine function in the form of:

$$Y = \frac{d(\cosh(ax) - 1)}{\cosh(ar) - 1}$$

wherein:

Y is the vertical distance from the dimple apex, x is the radial distance from the dimple apex, a is a shape constant, d is the depth of the dimple, wherein the depth is about 0.025 inches, and r is the radius of the dimple, wherein the radius is about 0.05 inches.

2. The golf ball of claim 1, wherein the shape constant, a, is from about 20 to about 100.

3. The golf ball of claim 1, wherein about 30 percent or greater of the plurality of recessed dimples are defined by the revolution of a Caternary curve.

4. The golf ball of claim 1, wherein the at least one dimple has a volume ratio of about 50 percent or greater.

5. The golf ball of claim 1, wherein the at least one dimple has a volume ratio of about 51 percent to about 69 percent.

* * * * *